US008556081B2

(12) United States Patent
McIntosh et al.

(10) Patent No.: US 8,556,081 B2
(45) Date of Patent: Oct. 15, 2013

(54) DISPLAY BOX

(75) Inventors: John Ralph McIntosh, Tulsa, OK (US); Melvin C. Redman, Bentonville, AR (US); Neal Winston Zahn, Bixby, OK (US)

(73) Assignee: Winston Company, Inc., Tulsa, OK (US)

( * ) Notice: Subject to any disclaimer, the term of this patent is extended or adjusted under 35 U.S.C. 154(b) by 128 days.

(21) Appl. No.: 13/161,288

(22) Filed: Jun. 15, 2011

(65) Prior Publication Data

US 2012/0318710 A1 Dec. 20, 2012

(51) Int. Cl.
*B65D 5/50* (2006.01)

(52) U.S. Cl.
USPC ..... 206/764; 206/335; 206/503

(58) Field of Classification Search
USPC ..... 206/764, 335, 503, 507, 315.1, 756, 206/765, 557, 515, 477, 45.21, 777, 779; 220/501, 62; 229/103, 915, 917, 102.5
See application file for complete search history.

(56) References Cited

U.S. PATENT DOCUMENTS

| | | | | |
|---|---|---|---|---|
| 4,185,739 | A * | 1/1980 | Wilford | 206/477 |
| 4,595,097 | A | 6/1986 | Herstein | |
| 5,029,702 | A * | 7/1991 | Tong | 206/315.1 |
| 5,348,145 | A | 9/1994 | Steinfels, III | |
| 5,411,138 | A * | 5/1995 | Klawiter | 206/459.1 |
| 5,919,074 | A * | 7/1999 | Honda | 446/268 |
| 7,861,916 | B2 * | 1/2011 | Little | 229/120.26 |

* cited by examiner

*Primary Examiner* — Luan K Bui
*Assistant Examiner* — Rafael Ortiz
(74) *Attorney, Agent, or Firm* — Fellers, Snider, Blankenship, Bailey & Tippens, P.C.

(57) ABSTRACT

A system for shipping and displaying a vehicle is disclosed. A display box includes a vehicle receiving area that has a display area and an enclosed area so that when the vehicle is located in the display box a prospective purchaser can sit on the seat. For shipping a vehicle is affixed to a first display box and a second vehicle is affixed to a second display box. The second display box is inverted and reversed and is located above the first display box to form a rectangularly shaped shipping combination. First and second disposable pillars are located between the first and second vehicles to support the two display boxes when combined to form the shipping combination. In a preferred embodiment, the pillars locate in foot receiving areas of the vehicles in the first and second display boxes.

9 Claims, 5 Drawing Sheets

DISPLAY BOX

FIELD OF THE INVENTION

The invention relates to packaging and display of toys. In particular, the display box of the invention enables a child to sit on a toy while a toy is in the display box to assist prospective purchasers assessing whether the toy is an appropriate size, and the display box is configured to be stacked with other display boxes so that, in combination, the stacked boxes assume an approximately rectangular box shape for ease of shipping and stacking.

BACKGROUND OF THE INVENTION

Battery powered ride-on toys are popular among small children. Different sized ride-on toys are available that are suitable for children of different ages. Due to conventional packaging, consumers are faced with the prospect of having to estimate the size of the toy inside, which can lead to purchase of an incorrectly sized toy for a particular child.

"Try-me" packaging, wherein a consumer has an opportunity to manipulate the device prior to purchase, is one method of assisting the consumer in making correct purchasing decisions. However, packaging that allows a consumer to access a toy, particularly a large toy such as a ride-on vehicle, typically results in irregularly shaped packaging that can cause problems for shipping and stacking.

One object of the invention is to provide packaging wherein a consumer may sit on a toy vehicle or otherwise access the toy without requiring that the toy be removed from the packaging.

SUMMARY OF THE INVENTION

A system for shipping and displaying a vehicle is disclosed. In one embodiment, the vehicle is a child's ride-on toy having the appearance of a four-wheeler with an exposed seat. The system includes a display box having a vehicle receiving area. The vehicle receiving area has a display area and an enclosed area. The enclosed area is sized to receive a first, e.g., rear, portion of the vehicle. The display area is sized to receive a second, e.g., front, portion of the vehicle, including the seat, for allowing a prospective purchaser to sit on the seat without removing the vehicle from the display box. In a preferred embodiment, the vehicle receiving area defines a display surface that can accommodate product identifying information and graphics.

An orienting member is preferably located within the vehicle receiving area. The orienting member defines receptacles for receiving the vehicle, thereby orienting the vehicle within the display box in a desired configuration. The receptacles may include a first wheel receptacle, a second wheel receptacle and an accessory receptacle, additional receptacles or a sub-combination of the above listed receptacles.

The vehicle receiving area is defined by a bottom box panel, a front box panel, a right box panel and a left box panel. The display area has an upper surface defined by an upper box panel. The upper box panel is at a first height above the bottom box panel. The front box panel has an upper surface at a second height above the bottom box panel, wherein the first height is greater than the second height so that the display surface is located above the vehicle for ease of viewing while a portion of the display box defining the display area of the vehicle receiving area is of a lower height to facilitate viewing of the vehicle.

For a preferred shipping method, a vehicle is affixed to a first display box. Wire ties are preferably used to secure the front axle of the first vehicle to a bottom panel of the first display box. A second vehicle is affixed to a second display box of the same shape and design as the first display box. Wire ties are preferably used to secure the front axle of the second vehicle to a bottom panel of the second display box. The second display box is inverted to be located above the first display box wherein a display end of the second display box is adjacent to a vehicle receiving end of the first display box, thereby forming a shipping combination.

The bottom box panel, the front box panel, the right box panel and the left box panel of the first display box and of the second display box of the shipping combination define a rectangular shape of a partial enclosure for facilitating ease of shipping and stacking of the shipping combination. First and second disposable pillars are located between the first and second vehicles to support the two display boxes when combined to form the shipping combination. In a preferred embodiment, the pillars locate in foot receiving areas of the vehicles in the first and second display boxes.

DETAILED DESCRIPTION OF THE PREFERRED EMBODIMENTS

Figure 1:
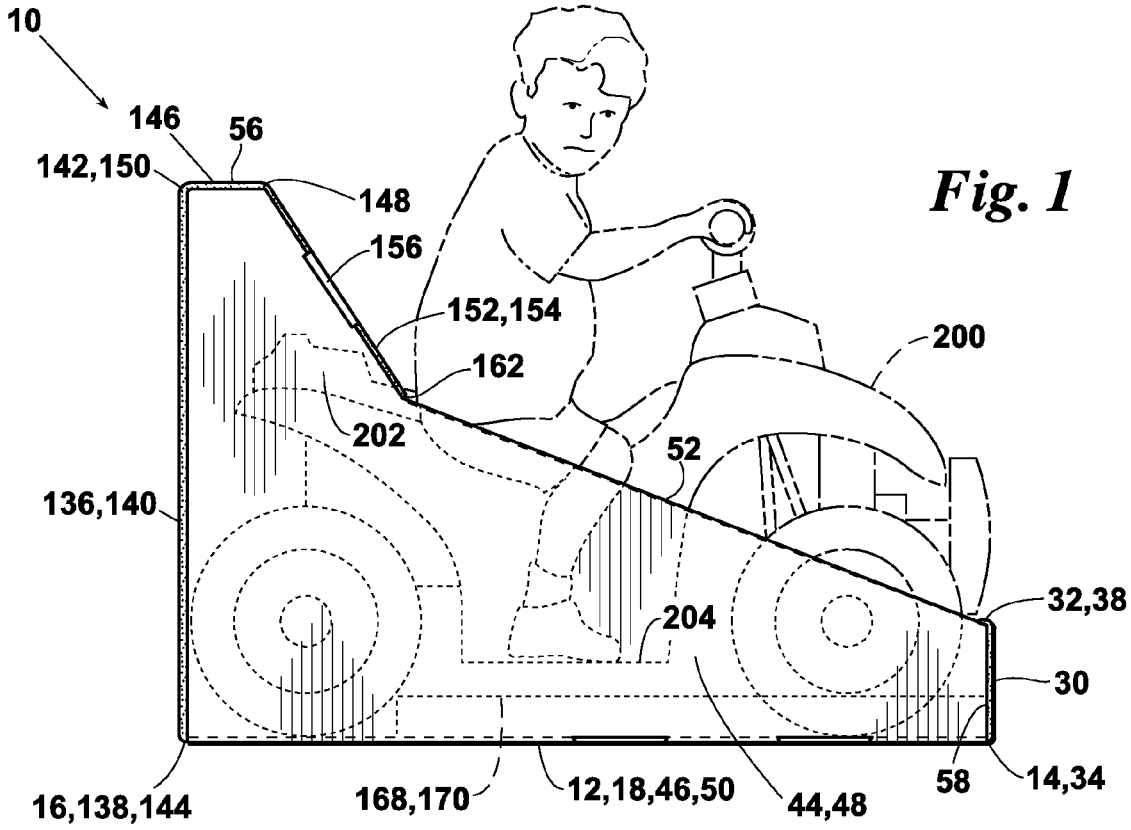
FIG. 1 is a right side plan view of the box of the invention showing a ride-on toy and child in phantom.

Referring now to FIGS. 1 through 9, shown is a display box designated generally 10. Display box 10 includes a bottom box panel 12 defined by front fold 14, rear fold 16, right fold 18, and left fold 20. Front fold 14 defines front tab receiving slots 22. Right fold 18 defines right tab receiving slots 24. Left fold 20 defines left tab receiving slots 26.

A rear bottom surface attachment 28 extends from rear fold 16 of bottom box panel 12. A front box exterior panel 30 has a top surface 32. Front box exterior panel 30 has a bottom surface 34 adjacent to front fold 14 of bottom box panel 12.

A front box interior panel 36 has a top surface 38 that is hingedly affixed to top surface 32 of front box exterior panel 30. Front box interior panel 36 has a bottom surface 40 having front tabs 42 extending therefrom for locating in front tab receiving slots 22. Front box exterior panel 30 is on a vehicle receiving end of display box 10.

A right box panel 44 has a bottom surface 46 hingedly affixed to right fold 18. Right box panel 44 has a right outer box surface 48 having a bottom edge 50 affixed to right fold 18. Right outer box surface 48 has a right angled first upper surface fold 52, a right angled second upper surface fold 54, right top fold 56, right front fold 58, and right rear fold 60. Right inner box panel 62 has a bottom edge 64 and an upper edge 66 hingedly affixed to right box panel 44 at angle first upper surface fold 52. Right inner box panel 62 has front tabs 68 on bottom edge 64 for inserting right tab receiving slots 24. Right inner display surface panel 70 is hingedly affixed to right box panel 44 at right angled second upper surface fold 54. Right inner display surface panel 70 defines a right upper tab receiving slot 72. Right inner upper member 74 has front edge 76 and inner edge 78 and is hingedly affixed to right top fold 56. Right inner forward facing display surface member 80 is hingedly affixed at front edge 76 of right inner upper member 74. Right box panel 44, front box interior panel 36, left box panel 94 and bottom box panel 12 define a display area of a vehicle receiving area.

Right inner rear panel 82 is hingedly affixed to right rear fold 60. Right front tab inner fold member 84 is hingedly affixed to right front fold 58. Right front tab 86 extends from right front tab inner fold member 84 for insertion into front tab receiving slot 22.

A left box panel 94 has a bottom surface 96 hingedly affixed to left fold 20. Left box panel 94 has a left outer box surface 98 having a bottom edge 100 affixed to left fold 68. Left outer box surface 98 has a left angled first upper surface fold 102, a left angled second upper surface fold 104, left top fold 106, left front fold 108, and left rear fold 110. Left inner box panel 112 has a bottom edge 114 and an upper edge 116 hingedly affixed to left box panel 94 at angle first upper surface fold 102. Left inner box panel 112 has front tabs 118 on bottom edge 114 for inserting left tab receiving slots 26. Left inner display surface panel 120 is hingedly affixed to left box panel 94 at left angled second upper surface fold 104. Left inner display surface panel 120 defines a left upper tab receiving slot 122. Left inner upper member 124 has front edge 126 and inner edge 128 and is hingedly affixed to left top fold 106. Left inner forward facing display surface member 130 is hingedly affixed at front edge 126 of left inner upper member 124. Left inner rear panel 132 is hingedly affixed to left rear fold 110.

Left front tab inner fold member 134 is hingedly affixed to left front fold 108. Left front tab 135 extends from left front tab inner fold member 134 for insertion into front tab receiving slot 22.

Rear box panel 136 has bottom edge 138 affixed to rear bottom surface attachment 28. Rear box panel 136 has rear box surface 140. Rear box surface 140 has top edge 142 and bottom edge 144 affixed to rear bottom surface attachment 28. Upper box panel 146 has front edge 148 and rear edge 150. Rear edge 150 is affixed to top edge 142 of rear box panel 136. Forward facing display panel 152 has right edge 154 that defines right upper tab 156 for locating in right upper tab receiving slot 72. Forward facing display surface 152 has left edge 158 that defines a left upper tab 160 for locating in left upper tab receiving slot 122. Forward facing display surface 152 has bottom edge 162 and a top edge 164 that is hingedly affixed to front edge 148 of upper box surface 146. Forward facing interior panel 166 is hingedly affixed to bottom edge 162 of forward facing display surface 152. Right box panel 44, rear box panel 136, left box panel 94 and forward facing display surface 152 define an enclosed portion of a vehicle receiving area. Rear body panel 136 is on a display end of display box 10.

An orienting member designated generally 168 has horizontal panel 170. Horizontal panel 170 has a front edge 172, rear edge 174, right edge 176, and left edge 178. Front vertical panel 180 is hingedly affixed to front edge 172. Rear vertical panel 182 is hingedly affixed to rear edge 174. Right vertical panel 184 is hingedly affixed to right edge 176. Left vertical panel 186 is hingedly affixed to left edge 178. Horizontal panel 170 defines first wheel receiving orifice 188, second wheel receiving orifice 190 and accessory receiving orifice 192. Horizontal panel 170 has a width and a length that is less than a width and a length of bottom box panel 12.

To construct display box 10, rear box panel 136 is secured to rear bottom surface attachment 28. Right box panel 44 and left box panel 94 are folded about right fold 18 and left fold 20, respectively, to orient panels 44 and 94 vertically.

Right inner box surface 62 is folded about right angled first upper surface fold 52 and right front tabs 68 are inserted in right tab receiving slots 24. Left inner box surface 112 is folded about left angled first upper surface fold 102 and left front tabs 118 are inserted in left tab receiving slots 26.

Right front inner tab fold member 84 is folded about right front fold 58 so that right front tab 86 may be inserted in front tab receiving slot 22. Left front inner tab fold member 134 is folded about left front fold 108 so that left front tab 136 may be inserted in front tab receiving slot 22. Front box exterior panel 30 is then folded about front fold 14 to a vertical orientation. Front box interior panel 36 is then folded at top surface 32 of front box exterior panel 30 to enclose inner tab fold members 84 and 134 between front box exterior panel 30 and front box interior panel 36. Front tabs 42, extending from bottom surface 46 of front box interior panel 36, are inserted in front tab receiving slots 22, thereby forming a sturdy front box surface.

Right inner display surface panel 70 is folded about right angled second upper surface fold 54. Left inner display surface panel 120 is folded about left angled second upper surface fold 104. Right inner rear fold panel 82 is then folded inwardly about rear right fold 60. Left inner rear fold panel 132 is then folded inwardly about rear left fold 110. Right inner upper member 74 and attached inner front facing display surface 80 are folded inwardly about right top fold 56. Left inner upper member 124 and attached inner front facing display surface 130 are folded inwardly about left top fold 106.

Rear box surface 136 is then folded about rear fold 16 to a vertical orientation. Upper box surface 146 is folded about top edge 150 and front facing display surface 152 is folded about front edge 148. Right upper tab 156 is inserted within right upper tab receiving slot 72. Left upper tab 160 is received in left upper tab receiving slot 122. Forward facing interior panel 166 is then folded about bottom edge 162 of front facing display surface 152, thereby completing an upper portion of the box assembly and assembly of display box 10.

Orienting member 168 is then assembled by folding front vertical panel 180 downwardly about front edge 172 of horizontal panel 170 to a vertical orientation. Rear vertical panel 182 is folded downwardly about rear edge 174 to a vertical orientation. Right vertical panel 184 is folded downwardly about right edge 176 to a vertical orientation. Left vertical panel 186 is folded downwardly about left edge 178 to a vertical orientation.

Orienting member 168 may then be located within a receiving area defined by display box 10, wherein bottom edges of vertical panels 180, 182, 184, and 186 are supported by bottom box panel 12. Front vertical panel 180 is located adjacent to front box interior panel 36. Right vertical panel 184 is located adjacent to right inner box surface 62. Left vertical panel 186 is located adjacent to left inner box surface 112.

Orienting member 168 may then receive a ride-on toy such as ride-on toy 200. In particular, a right front wheel of a ride-on toy may be received in first wheel receiving orifice 188 and a left front wheel of a ride-on toy may be received in second wheel receiving orifice 190. A battery or other component may be received in a accessory receiving orifice 192. Preferably, ride-on toy 200 is secured to bottom of box panel 12 of display box 10 with wire ties that are affixed to a front axle of toy 200.

As shown in FIG. 1, after locating ride on toy 200 in display box 10, ride on toy seat 202 and foot rest 204 of foot rests 204, 206 are visible and accessible in front of forward facing display surface 152. Therefore, a child can sit on seat 202 of ride on toy 200 so that prospective purchasers can assess whether toy 200 is the appropriate size for the child.

Figure 2:
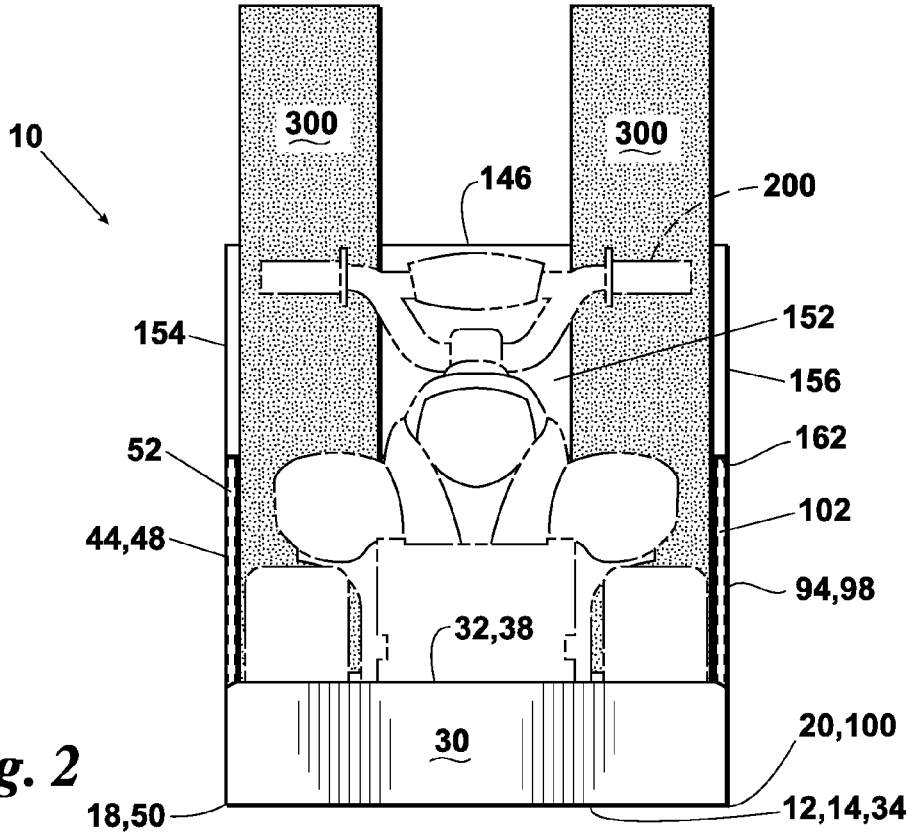
FIG. 2 is a front plan view of the box of FIG. 1 showing the toy in phantom and including shipping pillars.
Figure 3:
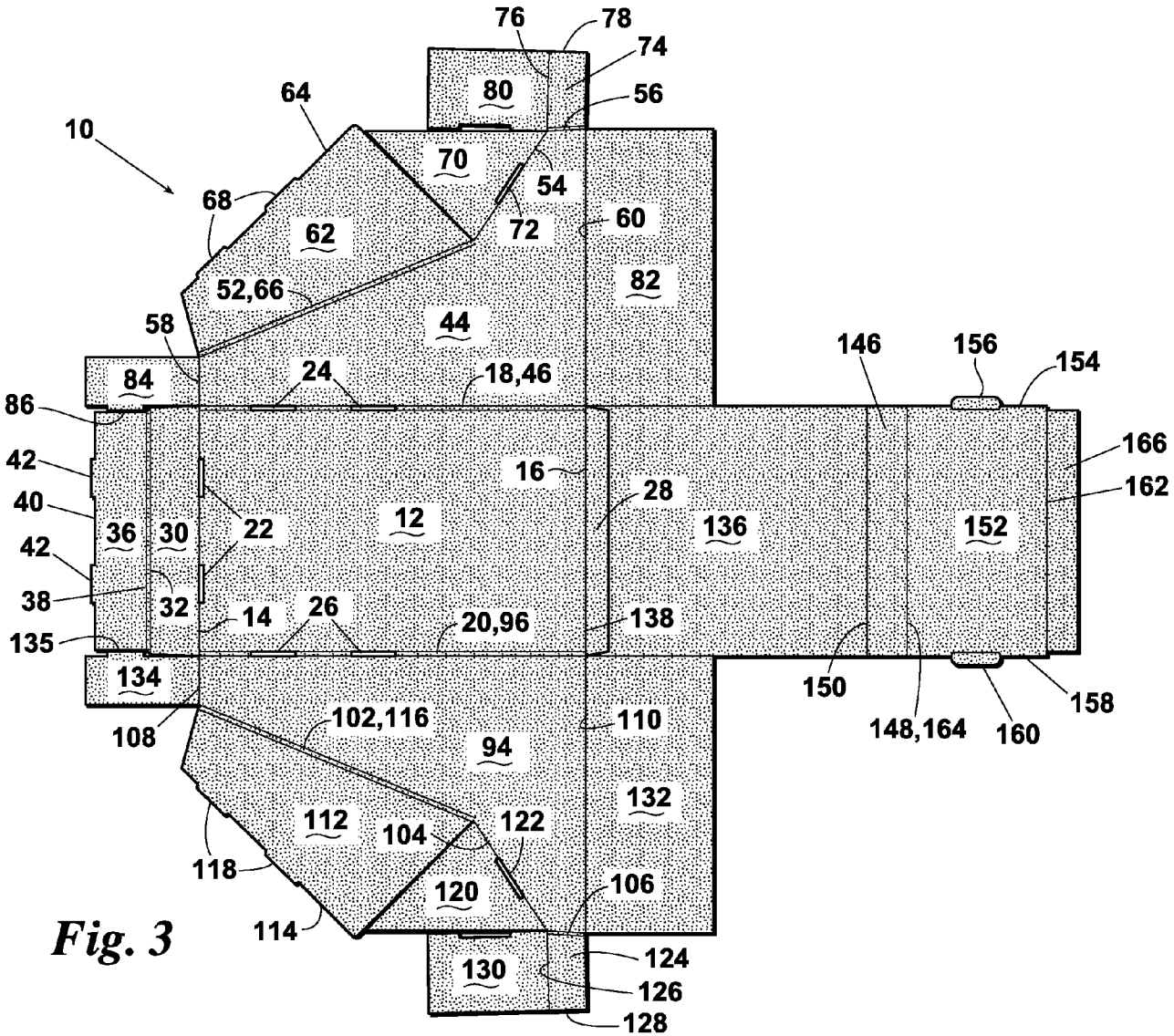
FIG. 3 is a top view of the box of FIG. 1 shown in a disassembled configuration.
Figure 4:
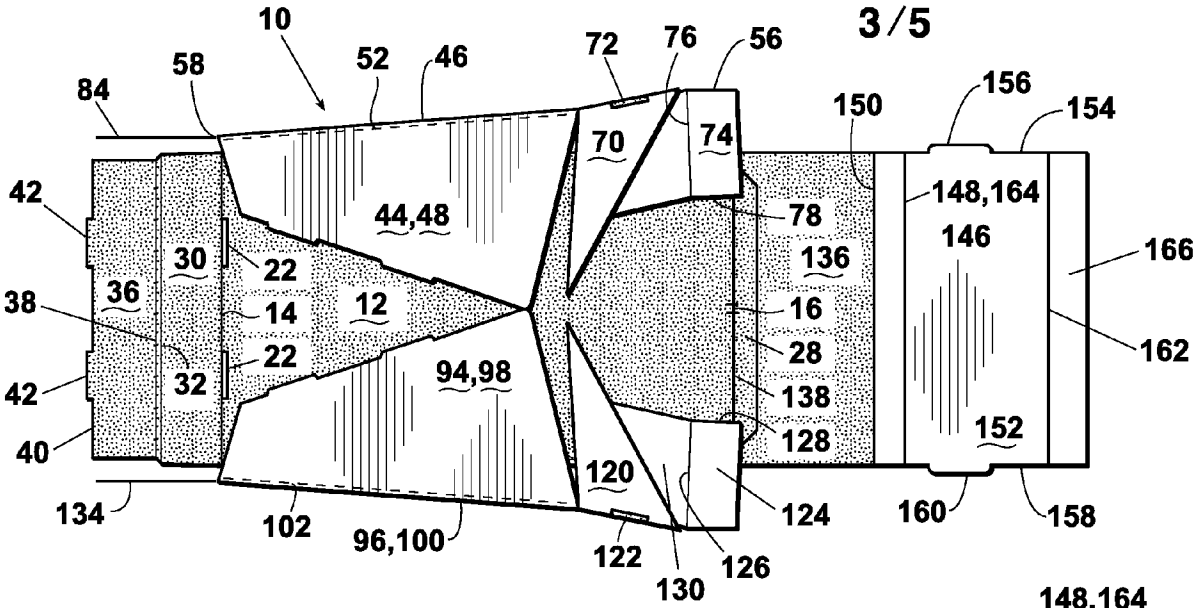
FIG. 4 is a top view of the box of FIG. 1 shown in a partially folded configuration.
Figure 6:
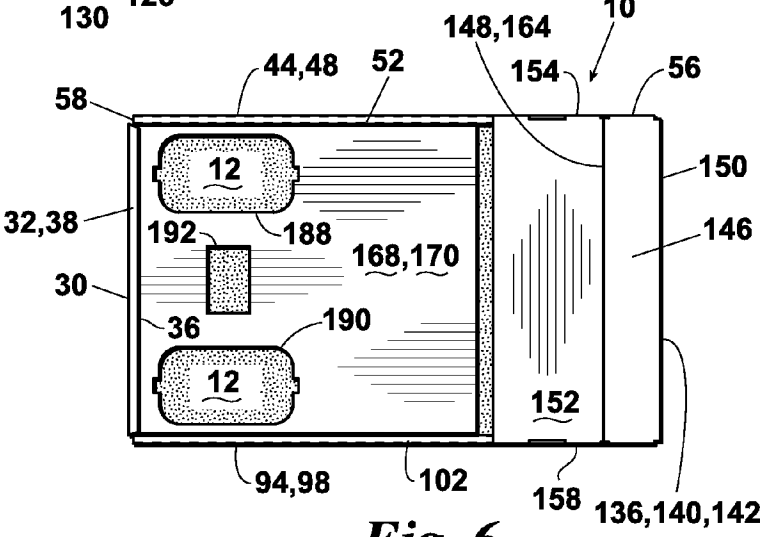
FIG. 6 is a top view of the box of FIG. 1 in an assembled configuration with an orienting panel in place.
Figure 5:
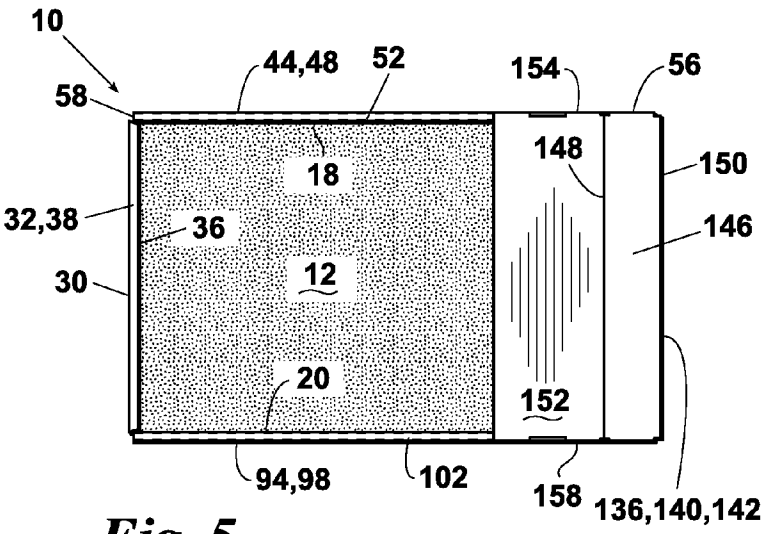
FIG. 5 is a top view of the box of FIG. 1 in an assembled configuration.
Figure 8:
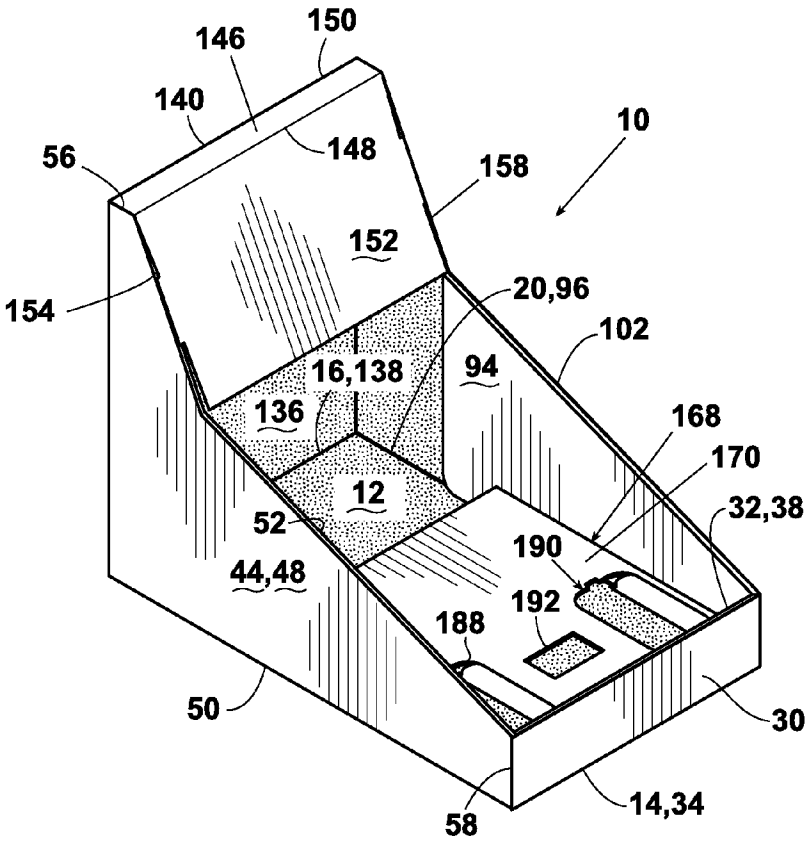
FIG. 8 is a perspective view of the box of FIG. 1.
Figure 7:
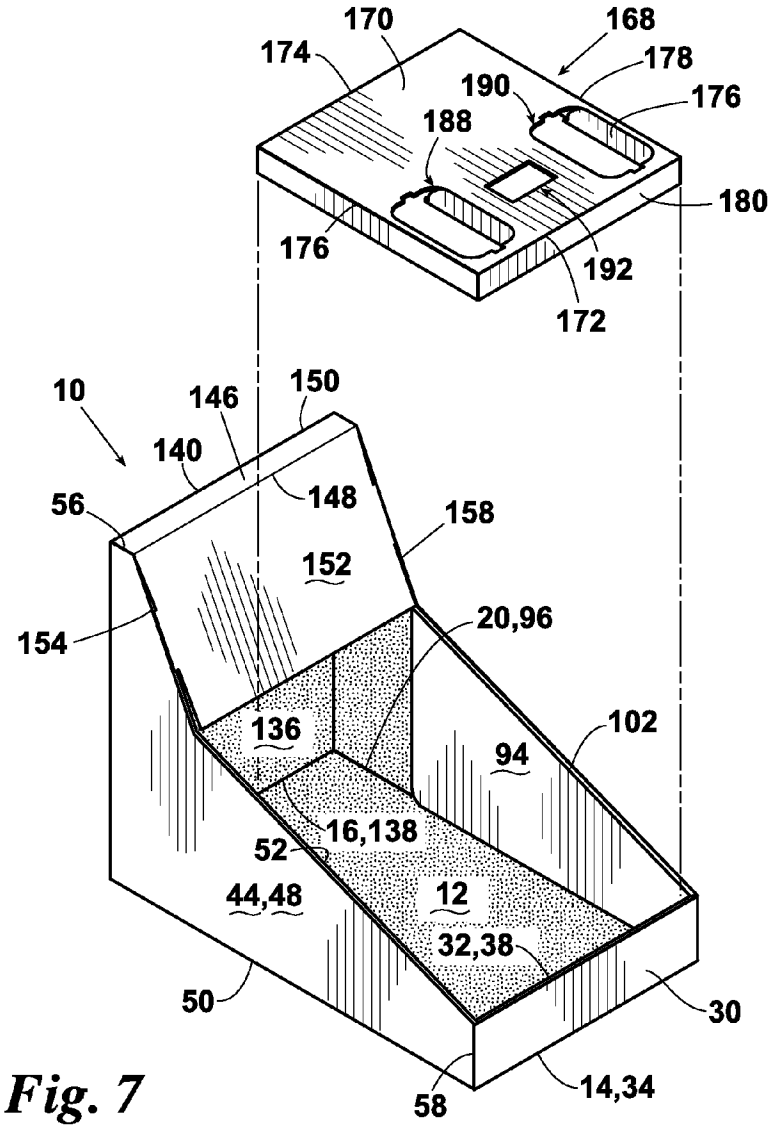
FIG. 7 is an exploded perspective view of the box of FIG. 1.
Figure 9:
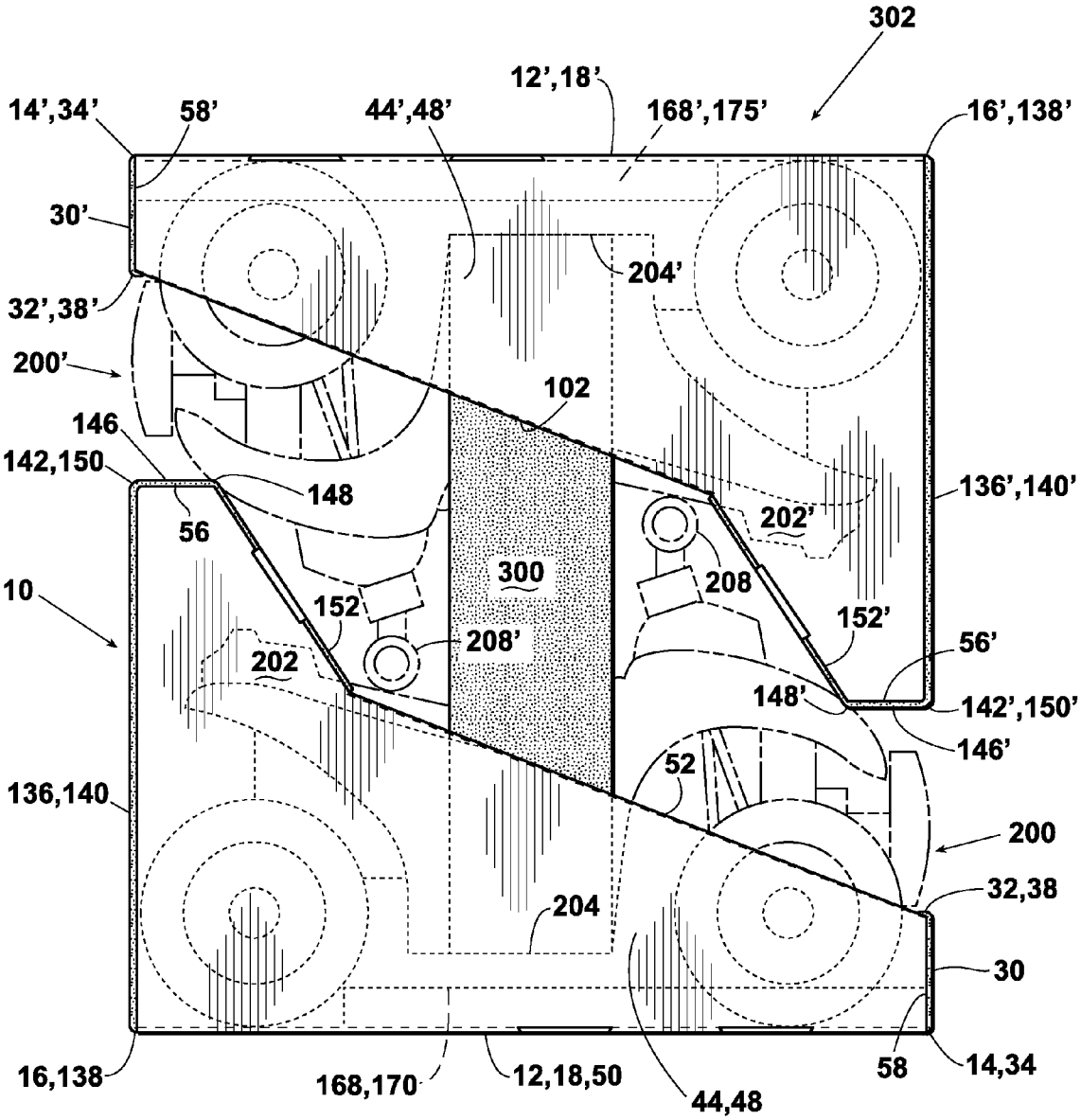
FIG. 9 is an elevation view of a first box stacked in combination with a second box to assume a rectangular configuration.

Additionally, the design of display box 10 facilitates uniform stacking when shipped with disposable pillars 300 (FIGS. 2 and 9). Pillars 300 are preferably constructed of an inexpensive and light weight material, such as styrofoam. Pillars 300 are preferably sized to be received on foot rests, 204, 206 so that display boxes 10 and toys 200 can be stacked on upon another, which results in an approximately rectangular box shape 302 of the shipping combination as shown in FIG. 9. In addition to pillars 300 engaging foot rests 204, 206 of first toy 200 and foot rests 204', 206', of a second toy 200', front edge 148 of display box 10 engages a second toy 200' and front edge 148' of second display box 10' engages first toy 200 (FIG. 9). Additionally, handlebars 208 of first toy 200 engage seat 202' of second toy 200' and handlebars 208' of second toy 200' engage seat 202 of first toy 200 to provide a stable shipping platform. After shipping, pillars 300 are removed and discarded.

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. A system for shipping and displaying a vehicle having a seat, said system comprising:

a ride-on vehicle having a seat and wheels;

a display box having a vehicle receiving area;

said vehicle receiving area having a display area and an enclosed area;

wherein said enclosed area receives a portion of the vehicle; and wherein said display area receives a portion of the vehicle, including the seat, for allowing a prospective purchaser to sit on the seat while said vehicle is received within said display area;

wherein said display box has a bottom box panel defining a lower surface of said display box;

and further comprising:

an orienting member received within said vehicle receiving area, said orienting member having receptacles for receiving said wheels of the vehicle, said wheels passing through said receptacles and contacting said bottom box panel for providing a stable platform for supporting a prospective purchaser sitting on said vehicle.

2. The system according to claim 1 wherein:

said vehicle receiving area defines a display surface.

3. The system according to claim 1 wherein:

said receptacles include at least one of a first wheel receptacle, a second wheel receptacle and an accessory receptacle.

4. The system according to claim 1, wherein:

said vehicle has wheels;

said display box has a bottom box panel defining a lower surface of said display box;

wherein said wheels contact said bottom box panel for providing a stable platform for supporting said prospective purchaser sitting on said vehicle.

5. A system for shipping and displaying a vehicle having a seat, said system comprising:

a first ride-on vehicle having a first seat and a first member;

a first display box having a vehicle receiving area;

said vehicle receiving area having a display area and an enclosed area;

wherein said enclosed area receives a portion of the first vehicle; and wherein said display area receives a portion of the first vehicle, including the first seat, for allowing a prospective purchaser to sit on the first seat while said first vehicle is received within said display area; wherein said vehicle receiving area is defined by a bottom box panel, a front box panel, a right box panel and a left box panel; and said display area has an upper surface defined by an upper box panel;

said first vehicle affixed to said first display box and further comprising:

a second display box having a second vehicle affixed thereto;

wherein said first display box has a front panel, a rear panel, a right panel, a left panel, and a bottom panel;

wherein said second display box has a front panel, a rear panel, a right panel, a left panel, and a bottom panel;

wherein said second display box is inverted to be located above said first display box and to have a display end adjacent to a vehicle receiving end of said first display box, thereby forming a shipping combination;

wherein said second vehicle has a second member and a second seat, said first member supporting said second seat and said first seat supporting said second member;

wherein said bottom panel, said front panel, said right panel and said left panel of said first display box and said bottom panel, said first panel said right panel, and said left panel of said second display box of said shipping combination define a rectangular shape of a partial enclosure for facilitating ease of shipping and stacking of said shipping combination;

said first vehicle defines a first right pillar receiving area and a first left pillar receiving area;

said second vehicle defines a second right pillar receiving area and a second left pillar receiving area; and further comprising:

a right removable shipping pillar engaging said first right pillar receiving area and said second right pillar receiving area;

a left removable shipping pillar engaging said first left pillar receiving area and said second left pillar receiving area; and wherein said right pillar and said left pillar provide support to assist in maintaining said rectangular shape of said partial enclosure of said shipping combination.

6. The system according to claim 5 wherein:

said upper box panel is at a first height above said bottom box panel;

wherein said front box panel has an upper surface at a second height above said bottom box panel; and wherein said first height is greater than said second height.

7. A method of packaging a toy vehicle comprising the steps of:

locating a first vehicle having a first seat in a vehicle receiving area of a first display box, said vehicle receiving area having a display area and an enclosed area;

wherein said display area is defined by a right box panel, a left box panel, and a front panel;

wherein a portion of said first vehicle is located in said enclosed area; and wherein a portion of said first vehicle, including said first seat, is located in said display area, for allowing a prospective purchaser to sit on said first seat;

locating a second vehicle in a second display box;

wherein said first display box having said front panel and a rear panel;

wherein said second display box has a front panel and a rear panel, a right box panel and a left box panel;

inverting said second display box;

orienting said second display box above said first display box so that a display end of said second display box is adjacent to a vehicle receiving end of said first display box;

supporting a second member of said second vehicle with said first seat of said first vehicle and supporting a second seat of said second vehicle with a first member of said first vehicle;

wherein a bottom box panel, said front panel, said right box panel and said left box panel of said first display box and a bottom box panel, said front panel and said right box panel and said left box panel of said second display box in combination define a shipping combination having a rectangular shape for facilitating ease of shipping and stacking of said shipping combination;

locating a first end of a right removable shipping pillar in a first right pillar receiving area defined by said first vehicle;

locating a second end of said right pillar in a second right pillar receiving area defined by said second vehicle;

locating a first end of a left removable shipping pillar in a first left pillar receiving area defined by said first vehicle;

locating a second end of said left pillar in a second left pillar receiving area defined by said second vehicle; and wherein said right pillar and said left pillar provide support to assist in maintaining said rectangular shape of said shipping combination.

8. The method according to claim 7 further comprising the steps of:

locating an orienting member within said vehicle receiving areas of said first display box;

locating a first wheel and a second wheel of said first vehicle in receptacles defined by said orienting member, said wheels passing through said receptacles and contacting said bottom box panel for providing a stable platform for supporting a prospective purchaser sitting on said first seat of said first vehicle.

9. The method according to claim 7 wherein:

said step of locating said vehicle in said vehicle receiving area includes supporting said wheels of said first vehicle by a bottom box panel.

* * * * *